US009016600B2

(12) United States Patent
Pearson et al.

(10) Patent No.: US 9,016,600 B2
(45) Date of Patent: Apr. 28, 2015

(54) COMPRESSED GAS CARTRIDGE POWERED PEPPER SPRAY GUN

(75) Inventors: Henry Pearson, New Braunfels, TX (US); Glen Arnott, New Braunfels, TX (US)

(73) Assignee: Daniel A. Holt, San Antonio, TX (US)

( * ) Notice: Subject to any disclaimer, the term of this patent is extended or adjusted under 35 U.S.C. 154(b) by 1062 days.

(21) Appl. No.: 12/579,027

(22) Filed: Oct. 14, 2009

(65) Prior Publication Data

US 2010/0090026 A1 Apr. 15, 2010

Related U.S. Application Data

(60) Provisional application No. 61/196,204, filed on Oct. 15, 2008.

(51) Int. Cl.

| | |
|---|---|
| ***A61M 11/02*** | (2006.01) |
| ***B05B 9/04*** | (2006.01) |
| ***F41H 9/10*** | (2006.01) |

(52) U.S. Cl.

CPC ..... *F41H 9/10* (2013.01)

(58) Field of Classification Search

USPC ..... 169/85, 88; 239/152, 373, 337, 303, 239/308; 222/396, 399

See application file for complete search history.

(56) References Cited

U.S. PATENT DOCUMENTS

| | | | | |
|---|---|---|---|---|
| 2,832,425 | A * | 4/1958 | Jacobs | 169/74 |
| 2,841,227 | A * | 7/1958 | Betzler | 169/77 |
| 3,858,659 | A * | 1/1975 | Fukushima | 169/77 |
| 4,310,108 | A * | 1/1982 | Motoyama et al. | 222/396 |
| 4,407,454 | A * | 10/1983 | Massey | 239/154 |
| 6,679,437 | B2 | 1/2004 | Truelove | |
| 2009/0078321 | A1 * | 3/2009 | Arnott et al. | 137/14 |

* cited by examiner

*Primary Examiner* — Dinh Q Nguyen

(74) *Attorney, Agent, or Firm* — Jackson Walker, LLP

(57) ABSTRACT

A pepper spray gun assembly having a trigger valve for dispensing a non-lethal spray, such as a pepper spray. The assembly includes a storage cylinder for receiving a non-lethal spray charge and a smaller pre-charged charging cylinder for engaging the storage cylinder. The charging cylinder is fluidly coupled to the storage cylinder so as to provide a regulated gas in the head space of the storage cylinder. When the trigger of the trigger valve is operated, the regulated gas will force the charge to be expelled through the nozzle of the trigger valve assembly.

13 Claims, 5 Drawing Sheets

COMPRESSED GAS CARTRIDGE POWERED PEPPER SPRAY GUN

This patent application claims the benefit of, priority from, and incorporates herein by reference U.S. Provisional Application Ser. No. 61/196,204, filed Oct. 15, 2008.

FIELD OF THE INVENTION

Pepper spray delivery systems, more specifically, a compressed gas cartridge powered pepper spray gun.

BACKGROUND

Non-lethal spray, such as pepper spray, is sometimes used to control unruly crowds. Pepper spray to the face can sting the eyes of the unfortunate recipient and is sometimes used by prison guards to quell riots.

FIGS. 1A, 1B, 1C, and 1D illustrate a present (that is to say, prior art) system for compressed air delivery of a pepper spray charge, as well as a procedure for using the present system.

Briefly, the present system includes a storage cylinder 12 having a threaded end 12A. The storage cylinder 12 is typically filled about half full with a water/ground pepper slurry ("M"). A firing unit 16 functions to expel the slurry M when the system is charged with a compressible gas through a charging port 30. The firing unit 16 includes a dip tube 18 (also known as a charge delivery tube) extending into the slurry, the dip tube typically having a weighed end 18A. The firing unit also includes a trigger valve 20 including a trigger/hand guard 22. A trigger grip 24 and a spray nozzle 26 are also typically included in the present system as part of firing unit 16.

Trigger valve 20 will release a high pressure pulse of gas carrying part of the charge M which will pass out of spray nozzle 26. Weighed end 18A is designed to maintain the end of the dip tube in slurry M when the pepper spray gun of the present system is brought into firing position as illustrated in FIG. 1C.

The present procedure using the present system illustrated in FIGS. 1A, 1B, and 1C for charging and use is generally as follows. A storage cylinder, typically about 46 oz. capacity, is filled to slightly over half full with the water/ground pepper slurry M. Then the firing unit 16, including threaded end 20A of trigger valve 20, is threadably engaged to threaded end 12A of storage cylinder 12, such that weighed end 18A is in the slurry M. Next, a charging system, such as a compressor or a large storage tank, is engaged to charging port 30 and charges the storage cylinder with compressed gas to the extent of the non-liquid space in the approximately half-filled storage cylinder 16. Compression is usually to about 250 psi and may be shown on pressure gauge 28. After the charging apparatus is disengaged from charging port 30, the system is ready for use.

There are a number of problems with the present system. These include the requirement for using the storage cylinder about approximately twice the liquid capacity of the charge. Further, it is often difficult to find a high pressure gas charging source. Thus, it is not convenient for field charging. Another problem is that output pressure decreases as pepper spray is sprayed out, that is to say, there is not a regulated gas pressure in the storage cylinder. Moreover, as output pressure decreases, the discharge loses range and accuracy.

Applicant's present system is designed to overcome these and other problems with the present system.

DETAILED DESCRIPTION OF THE PREFERRED EMBODIMENT

Figure 1D:
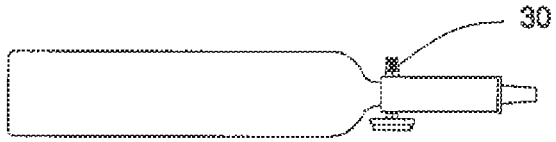
FIGS. 1A, 1B, 1C, and 1D illustrate an elevational view of the present system and present procedure for use with present state of the art compressed gas powered spray guns.
Figure 1A:
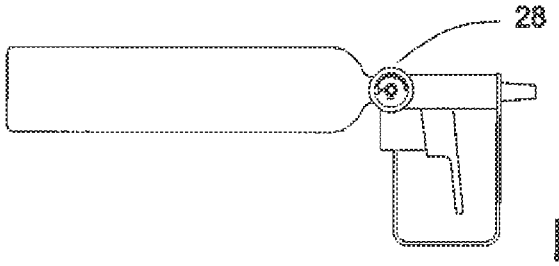
Figure 1B:
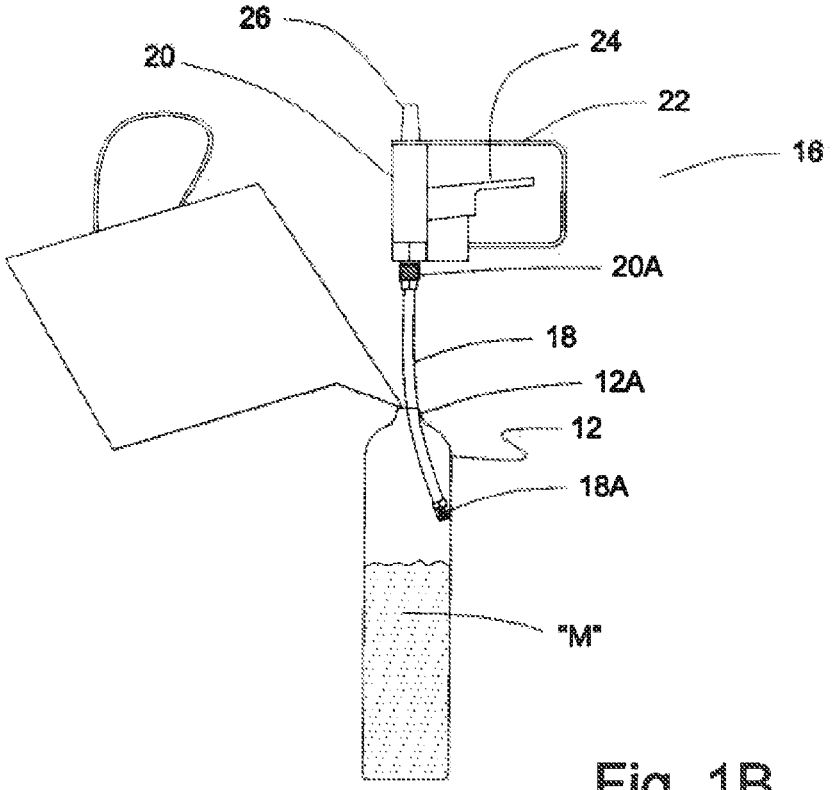
Figure 1C:
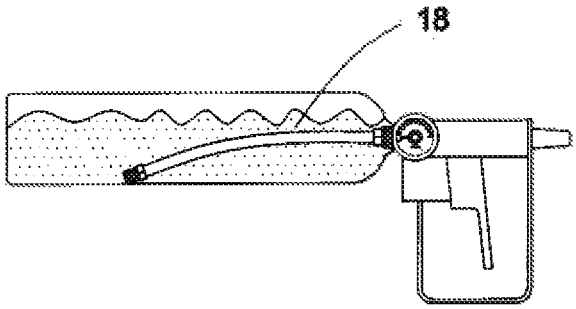
Figure 2:
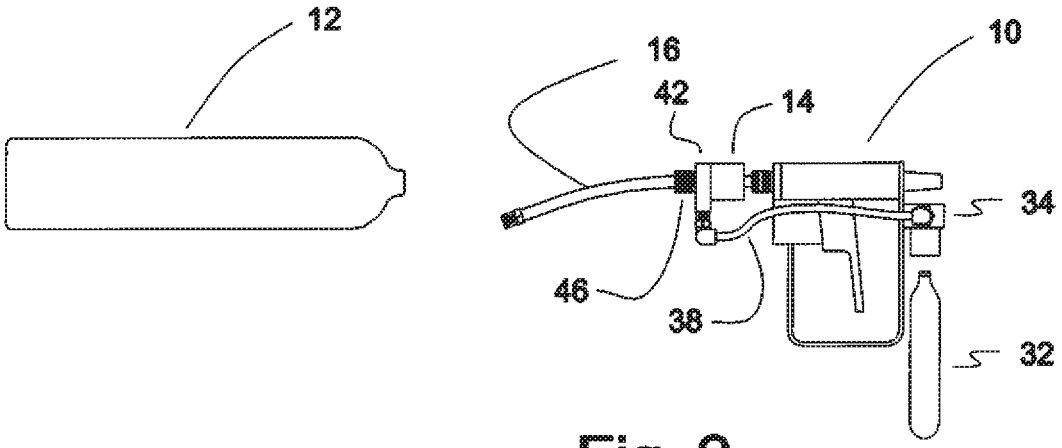
FIG. 2 illustrates an inside elevational exploded view of a spray gun according to one embodiment of Applicant's invention.
Figure 3:
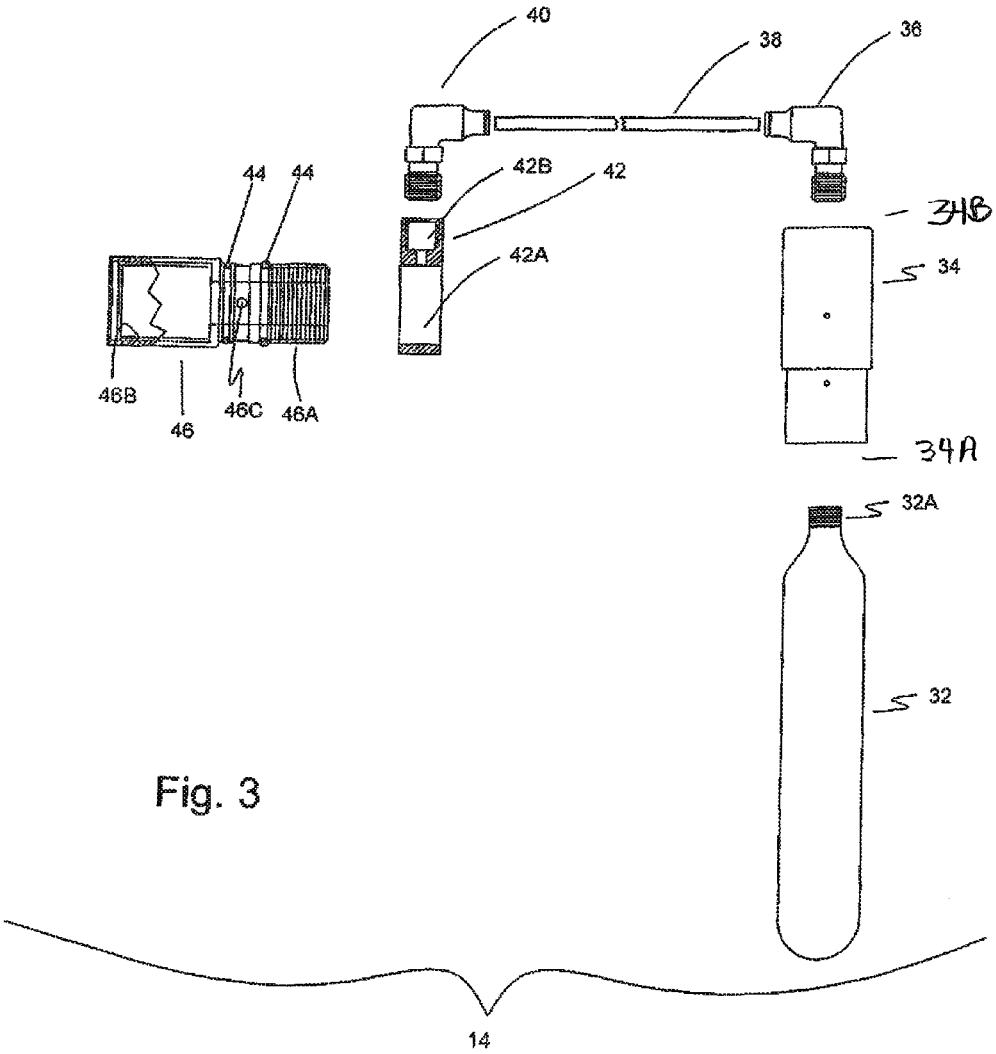
FIG. 3 is a detailed view of some of the components of Applicant's compressed gas cartridge powered spray gun.

FIGS. 2 and 3 illustrate a retrofit kit 14 that is adapted to engage the present system. Basically, retrofit kit 14 will add a small, pre-charged, reusable charging cartridge of high pressure gas to the present system and a pressure regulator on the charging cartridge to provide a regulated gas pressure to storage cylinder 12. The retrofit may also change out the present storage cylinder (typically non-refillable, about 600 pound capacity) for one, of about half to three quarters the length for use with a smaller, pre-charged, reusable charging cylinder. The preferred storage cylinder is refillable, about 1800 pounds working pressure and 10-20 inches long.

The advantages achieved by using Applicant's retrofit kit 14, which typically adapts to the present system, is that the present systems now are easily recharged by simply threading a small charging cartridge into the pressure regulator. Typically a number of small charging cylinders (2-6, for example) or cartridges may be carried by the user, as these pre-charged, single use cylinders typically are only about 6 inches tall in size.

Moreover, the length of the storage cylinder used on the present system may be cut in a third to a half while maintaining the same charge. This is because the storage cylinder can now be filled entirely with the slurry M. Also, the charging cylinder is sufficiently charged to expel a charge, relative to the storage cylinder, such that the positive storage tank pressure is maintained, through the regulator until the storage tank is empty of slurry. This helps to ensure that the charges are fired repeatedly with the same range and accuracy. This charge is typically about 250 psi.

The present system utilizes storage cylinders that are approximately 14 inches in length and Applicant may replace the present system storage cylinders with ones about 10 inches in size and not lose any charge capacity. Moreover, it is noted that expensive prior art charging systems or large field units are not necessary. Further, while it is noted that Applicant typically provides a retrofit kit 14 as set forth in FIGS. 2 and 3, it will be noted that a system utilizing Applicant's charging cartridge and regulator may be integrated and sold with the firing unit 16 when a pepper spray gun is made, rather than just an add-on to existing guns.

Applicant's gas cartridge retrofit system 14 typically utilizes a charging cartridge 32 typically having a threaded end 32A. Threaded end 32A engages a regulator 34, which regulator 34 is typically, but not necessarily, mounted to firing unit 16 by any type of convenient mounting member, for example, a clamp or a clip. One such firing unit is found on the Mk. 46 model pepper spray gun from Security Equipment Corporation, St. Louis, Mo. Pressure regulator 34 may be a set pressure or an adjustable pressure regulator fitting adapted to engage first fitting 36. One such regulator which may be used is a Rehvac Series 4000 regulator. The pressure regulator may be set, for example, to 250 psi. Pressure regulator 34 will have an input end 34A that receives high pressure charging gas from charging cartridge 32 and an output end 34B feeding regulated gas, for example, $N_2$ (preferably) at about 250 psi, to (optionally) a gas tight first fitting 36, as seen in FIG. 3. A preferred charging cylinder 32 contains compressed nitrogen or other suitable gas at about 2700-3000 psi. Tubing 38 will carry the regulated charging gas to a second fitting 40, which second fitting engages a swivel collar fitting 42 or other gas receiving assembly. The swivel collar fitting 42 engages an adapter fitting 46, which adapter fitting 46 will, at a threaded female end 46B, receive threaded male end 12A of storage cylinder 12. Male end 46*a* will thread into existing trigger valves. Thus, a regulated charging gas is carried from charging cartridge 32 to the storage cylinder 16, about a fitting or assembly that will allow delivery of the charge to the storage tank while, optionally, allowing the fitting to swivel about the storage cylinder while maintaining fitting integrity.

Swivel collar fitting 42 includes a central opening 42A and a threaded portion 42B. The center opening 42A is designed to receive in fluid sealing relation O-rings 44 (typically two) that are on either side of transfer port 46C. This will place swivel collar fitting 42 between threaded male end 46A and threaded female end 46B. Transfer port 46C will transfer the gas received into the swivel collar fitting 42 through the collar fitting, through transfer port 46C, and into at least the very top (head space) of the storage cylinder (depending on the amount of fluid of slurry M in the cylinder). O-rings 44 will allow the swivel collar fitting 42 to fit snugly between walls of female end 46B and walls adjacent threaded end 20A of trigger valve 20.

Figure 4A:
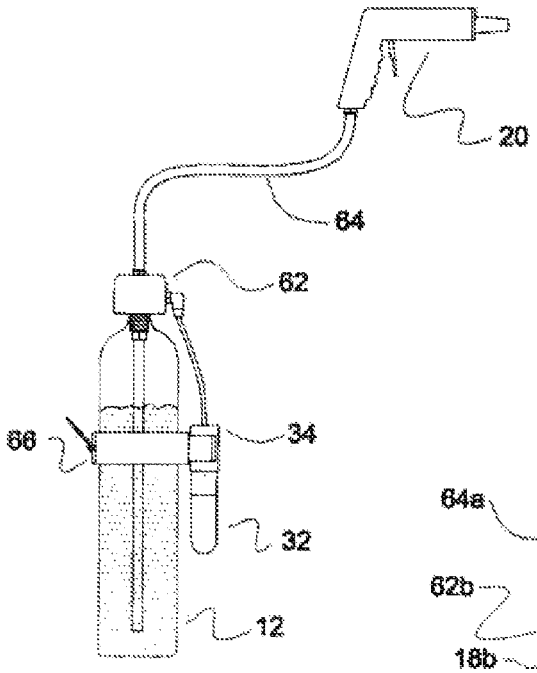
FIGS. 4A and 4B provide an alternate system of Applicant's use of a compressed gas cartridge powered pepper spray gun.
Figure 4B:
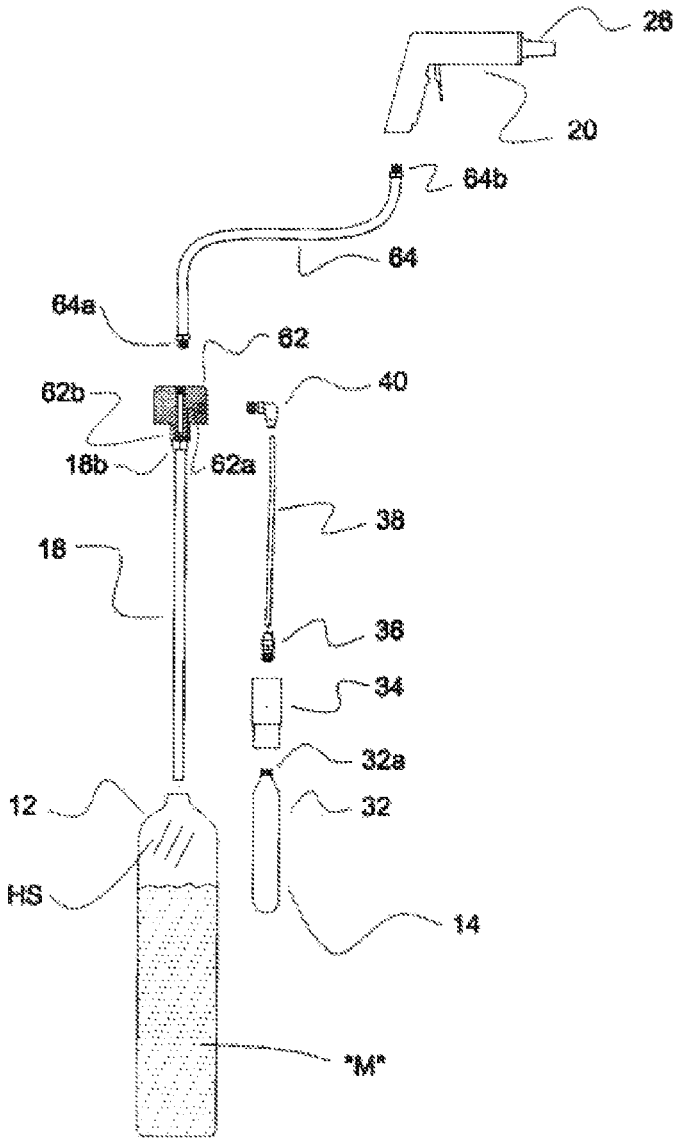

FIGS. 4A and 4B illustrate an alternate system of Applicant's novel compressed gas cartridge powered pepper spray gun, wherein benefits are achieved by providing a remote trigger valve 20 that is attached to an adapter 62 either directly or through a gas sealing line 64, such as a flexible line. There is an advantage to using a flexible line in freeing up the firing unit 16 or trigger valve 20 from the storage cylinder, in that it is less bulky.

This and other advantages are achieved by providing the gas cartridge retrofit system 14 with, in place of adapter fitting 46, a fitting 62 which is adapted to receive a first fitting 64A on flexible line 64. Fitting 62 threadably receives first fitting 64*a*, which fluidly connects end 18B of dip tube 18 (which in this embodiment may be rigid). That is to say, fitting 62 will provide gas sealing and fluid sealing connection of first fitting 64A to second end 18B of dip tube 18. Second end 18*b* is threaded outside to engage inside end 62*b* of fitting 62. Outside surface of end 62*b* screws into storage cylinder 12. The second function of fitting 62 is to receive high pressure gas from second fitting 40 of tubing 38 and to direct that gas through one or more channels 62*a* into head space HS above the charge "M" of the storage cylinder 12. That is to say, the function of both elements 46 and 62 is to provide a regulated charging gas to the head space from charging cartridge 32.

The alternate system illustrated in FIGS. 4A and 4B achieves this in providing adapter fitting 62 configured to deliver the charging gas into the head space by providing a separate gas sealing fitting between ends 64A and 18B, such that while head space HS is being charged, as "M" becomes dispensed, dip tube 18 and line 64 are joined in fluid sealing relation to carry fluid, under pressure from head space HS to trigger valve 20.

The use of swivel collar fitting 42 and adapter fitting 46 of the previous embodiment (FIGS. 2 and 3) achieves the same function of forcing charge through the dip tube 18 into the trigger valve 20, but with a direct fluid tight connection between the adapter fitting to the trigger valve, not a flexible line connection as seen in FIGS. 4A and 4B. Likewise, adapter fitting 46 allows for a fluid seal between end 18B of dip tube 18 directly into trigger valve 20, while at the same time allowing the charging gas to enter head space HS.

FIG. 4A illustrates the use of clip holder 66, wherein the clip is provided, which clip will engage a work belt of a user and/or which clip may include a strap or straps or other members to engage charging cartridge 32 to storage cylinder 12.

Figure 5:
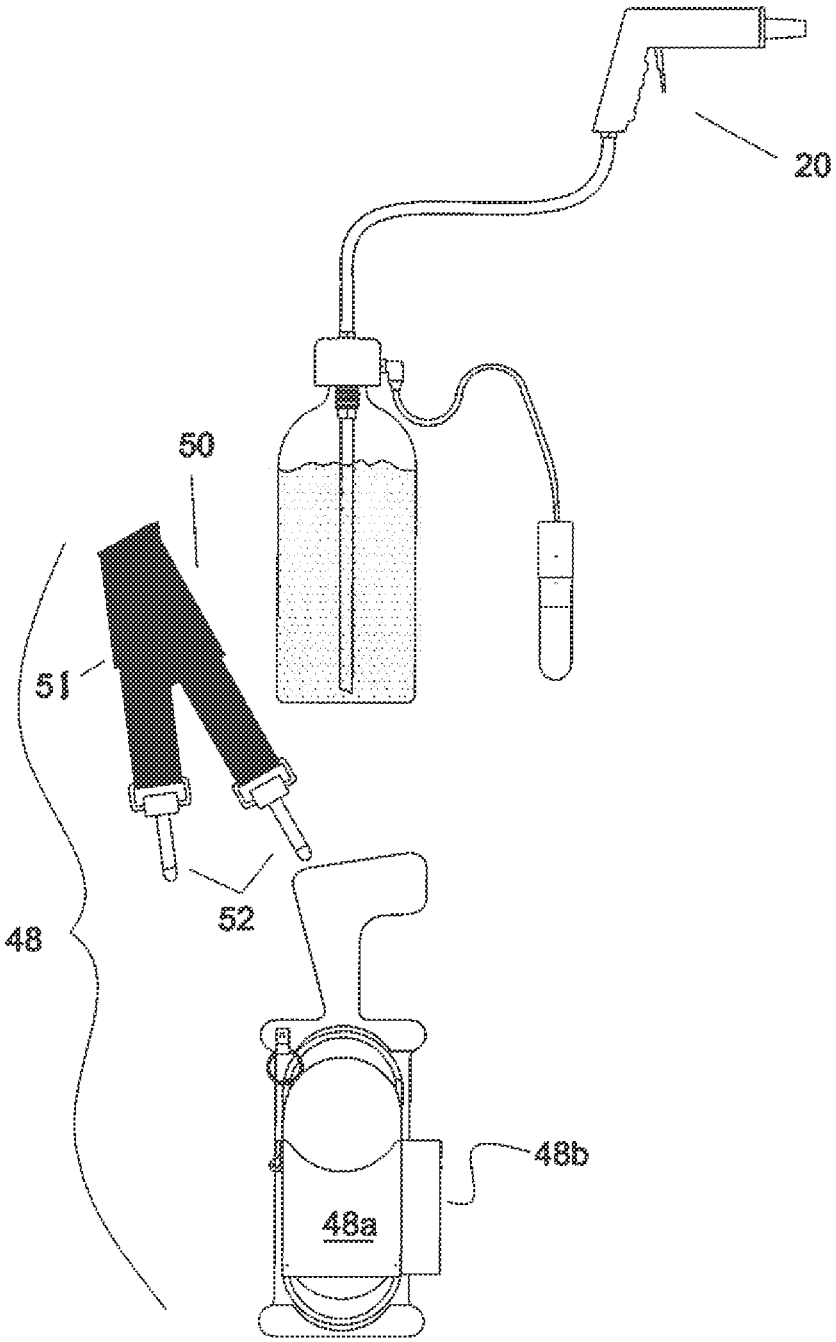
FIG. 5 illustrates an embodiment of Applicant's compressed gas cartridge powered spray gun and also illustrates the use of a sling/holster assembly.

FIG. 5 illustrates an embodiment of Applicant's pepper spray gun, which includes a sling/holster assembly 48 which is designed to allow the user to comfortably carry and hold the pepper spray assembly, including the storage cylinder in main pocket 48*a* and charging cylinder in small pocket 48*b*. More specifically, it is seen that the sling/holster assembly 48 may comprise a sling member 50, which may be fabric and may be adjustable as by an adjustment fitting 51 as part thereof. A swivel 52 is provided to engage the end of the sling to the pepper spray gun here, adjacent the handle thereof, near the top so as to allow the handle and guard to drop under the weight of gravity for engagement with a hand.

While the embodiments illustrated show the use of pressure dispensing of a liquid slurry mix, wherein the mix happens to include pepper spray, the embodiments of Applicant's novel invention may be used with any liquid or slurry that a user wishes to dispense under pressure. Moreover, spare charging cartridges may be provided with any of the systems disclosed herein, which may be engaged with a regulator as backup or disconnected.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. A spray gun comprising:

a storage cylinder adapted to receive and contain a liquid pepper spray composition under pressure, the storage cylinder having a dip tube extending thereinto;

a firing unit adapted to expel a spray charge under pressure, the firing unit having a nozzle, a charge delivery tube and a trigger;

a pressure regulator having a high pressure end and a regulated end, the pressure regulator adapted to provide an output having a constant pressure over a range of pressures received at the high pressure end;

a charging cylinder adapted to carry a compressed gas therein for engaging the regulator at a high pressure end thereof; and an assembly for engaging the regulated end of the regulator and the storage cylinder for providing a regulated pressure to a head space of the storage cylinder such that the firing unit expels a spray from the storage cylinder under compressed gas when the trigger of the firing unit is depressed and for engaging the dip tube extending into the storage cylinder;

wherein the charge delivery tube is adapted to engage the assembly so as to fluidly connect to the dip tube and connect the charge of the storage cylinder at a first end and the trigger at the second end, the trigger for selective expelling the spray composition.

2. The spray gun of claim 1, wherein the charging cylinder is between 4 and 8 inches long.

3. The spray gun of claim 1, wherein the storage cylinder is between 10 and 20 inches long.

4. The spray gun of claim 1, wherein the firing unit includes a clamp for engaging the charging cylinder.

5. The spray gun of claim 1, wherein the charging cylinder contains compressed nitrogen gas.

6. The spray gun of claim 1, wherein the storage cylinder includes a pocket for engaging the charging cylinder.

7. The spray gun of claim 6, wherein the charging cylinder is between 4 and 8 inches long, and wherein the storage cylinder is between 10 and 20 inches long.

8. The spray gun of claim 1, further including a flexible hose and wherein the firing unit is engaged to the storage unit through the flexible hose.

9. The spray gun of claim 8, further including a member for engaging the charging cylinder to either of the storage cylinder or the firing unit.

10. The spray gun of claim 8, further including a clip for engaging the storage unit to the belt of a user.

11. The spray gun of claim 1, further including a member for engaging the charging cylinder to either of the storage cylinder or the firing unit.

12. The spray gun of claim 1, wherein the charging cylinder is a pre-charged, disposable, single use charging cylinder.

13. The spray gun of claim 12, wherein the charging gas is nitrogen.

* * * * *